US006899985B2

(12) United States Patent
Inoue et al.

(10) Patent No.: US 6,899,985 B2
(45) Date of Patent: May 31, 2005

(54) TONER FOR DEVELOPING ELECTROSTATIC LATENT IMAGE

(75) Inventors: Masahide Inoue, Nara-Ken (JP); Chikara Tsutsui, Nishinomiya (JP); Yoshihiro Mikuriya, Nishinomiya (JP); Yoshitaka Sekiguchi, Nishinomiya (JP); Takeshi Arai, Akashi (JP); Megumi Aoki, Itami (JP); Masahiro Anno, Sakai (JP)

(73) Assignee: Minolta Co., Ltd., Osaka (JP)

( * ) Notice: Subject to any disclaimer, the term of this patent is extended or adjusted under 35 U.S.C. 154(b) by 23 days.

(21) Appl. No.: 10/200,333

(22) Filed: Jul. 23, 2002

(65) Prior Publication Data

US 2003/0108808 A1 Jun. 12, 2003

(30) Foreign Application Priority Data

Jul. 27, 2001 (JP) ..... 2001-227531

(51) Int. Cl.[7] ..... G03G 9/08

(52) U.S. Cl. ..... 430/108.8; 430/110.1; 430/108.4; 430/109.4

(58) Field of Search ..... 430/110.1, 108.8, 430/108.4, 109.4

(56) References Cited

U.S. PATENT DOCUMENTS 4,473,029 A * 9/1984 Fritz et al. ..... 430/122
5,176,978 A * 1/1993 Kumashiro et al. ..... 430/108.8
5,612,160 A * 3/1997 Inoue et al. ..... 430/108.8
5,643,705 A * 7/1997 Inoue et al. ..... 430/108.8
5,660,964 A * 8/1997 Machida et al. ..... 430/108.4
5,670,225 A * 9/1997 Yamanaka et al. ..... 428/40.1
5,712,071 A 1/1998 Mikuriya et al.
5,759,732 A 6/1998 Nakamura et al.
5,807,653 A 9/1998 Nishihara et al.
5,814,428 A 9/1998 Kido et al.
5,824,446 A 10/1998 Nishihara et al.
5,905,010 A 5/1999 Nakamura et al.
5,958,642 A 9/1999 Takagi et al.
5,972,547 A 10/1999 Yaguchi et al.
6,051,356 A 4/2000 Nishihara et al.
6,083,654 A * 7/2000 Lin ..... 430/108.8
6,415,127 B1 * 7/2002 Yamamoto et al. ..... 399/284
6,541,173 B1 * 4/2003 Kido et al. ..... 430/109.4

FOREIGN PATENT DOCUMENTS

JP 2000347451 A * 12/2000 ..... G03G/9/087

* cited by examiner

*Primary Examiner*—Christopher Rodee
(74) *Attorney, Agent, or Firm*—Burns, Doane, Swecker & Mathis, L.L.P.

(57) ABSTRACT

The present invention relates to a toner for developing an electrostatic latent image comprising a binder resin, a colorant, a first wax, and a second wax whose kind is different from that of the first wax, wherein the toner is prepared by a kneading-grinding method and integrated domains of the first wax and the second wax are dispersed in the binder resin.

23 Claims, 1 Drawing Sheet

TONER FOR DEVELOPING ELECTROSTATIC LATENT IMAGE

This application is based on an application No. 227531/2001 filed in Japan, the contents of which are hereby incorporated by reference.

BACKGROUND OF THE INVENTION

1. Field of the Invention

The present invention relates to a toner for developing an electrostatic latent image.

2. Description of the Related Art

As a conventional fixing system of toner, contact heating-fixing systems such as a heat roll-fixing system has been employed widely. In a fixing apparatus used in the heat roll-fixing system, a heat roll and a press roll are provided and a recording sheet supporting toner images is allowed to pass through a contact section (a nip section) between the heat roll and press roll so that the toner images are melted and fixed on the recording sheet.

In such contact heating-fixing systems represented by the heat roll-fixing system, the toner images on the recording sheet contact with the surface of a heating member (e.g. the heat roll) in a contact heating-fixing apparatus in order to be fixed. Therefore, it is necessary to prevent an offset phenomenon in which a part of the toner images is stuck to the heating member and the part is transferred on the next recording sheet to soil it.

The technique for preventing the offset phenomenon, in which a fixing oil such as silicone oil and the like is coated on or impregnated into the heat roll or the press roll of the fixing apparatus, has been known. However, in a monochrome image-forming apparatus, an oil-less fixing apparatus in which a fixing oil-coating system is omitted or the amount of the fixing oil to be coated is decreased is used from the viewpoint of miniaturization and low-cost of the fixing apparatus. When such a oil-less fixing apparatus is used, a wax is added in a toner as an anti-offset agent.

Moreover, the technique has been also known, in which not only the general wax for preventing the offset but also the different kind of wax are added in order to accomplish high improvements of toner-functions, such as a prevention of stains and blurs (smear) occurring on an image because of a rub at the time of both-sides copying or an improvement of low-temperature fixabilities and the like. In order to highly improve anti-offset properties and the other functions as just described, it is efficient to increase the content of various kinds of waxes in toner particles.

On the other side, in an image forming apparatus in which a full-color image is formed by using plural-color toners, the fixing oil such as silicone oil and the like has been conventionally coated on or impregnated into the heat roll or the press roll and, thereby, the prevention of the offset phenomenon and the maintenance of separabilities of a recording sheet from the heat roll and/or the press roll have been performed. The oil-less fixing of the full-color toners used in such a full-color image-forming apparatus has also been examined. In a general toner for reproducing a monochrome image, a resin having a high viscoelasticity can be used as a binder resin. Therefore, an intermolecular cohesive force is high at the time of toner-melting (being fixed) and, even when the content of wax is low, separabilities from fixing rollers and anti-offset properties can be maintained. However, when the binder resin having a high viscoelasticity is used in a full-color toner, light transmission properties, gloss properties and reproducibility of color become insufficient. Accordingly, in the full-color toner, the degree of dependence on wax for anti-offset properties and separabilities is high and it is necessary to increase the content of wax.

However, in general, a wax is incompatible with a binder resin and, when the blending amount of wax in raw material is increased in order to increase the content of wax, the amount of wax liberating from a toner particle is increased in the step of grinding a kneaded product at the time of producing toner. Therefore, the amount of wax that is actually comprised in a toner particle becomes lower than that in mixing raw material and, as a result, it is impossible to make wax be effectively comprised in a toner particle. Accordingly, the effects of improvements for toner properties (anti-offset properties, separabilities between a fixing member (a heat member and/or a press member) and a recording sheet, low-temperature fixabilities, smear-preventive properties) can not be shown sufficiently by adding wax under the present conditions. Moreover, when the liberating wax is increased, problems in which a maintenance of heat resistance of toner is deteriorated or filmings occur on an image arise.

Therefore, for the purpose of preventing the occurrence of the liberating wax, a trial in which wax is dispersed in a comparatively small particle size in order to restrict an exposure of wax to the surface of a toner particle has been carried out. However, the effects of improvements for the above-mentioned toner properties can not be shown sufficiently by adding wax.

SUMMARY OF THE INVENTION

The object of the present invention is to provide a toner for developing an electrostatic latent image which can sufficiently show the effects of improvements for toner properties by means of adding wax.

In other words, the object of the present invention is to provide a toner for developing an electrostatic latent image which is sufficiently excellent in anti-offset properties, separabilities between a fixing member (a heat member and/or a press member) and a recording sheet, low-temperature fixabilities, smear-preventive properties, a maintenance of heat resistance, and anti-filming properties.

The present invention relates to a toner for developing an electrostatic latent image characterized by comprising a binder resin, a colorant, a first wax, and a second wax whose kind is different from that of the first wax, wherein the toner is prepared by a kneading-grinding method and integrated domains of the first wax and the second wax are dispersed in the binder resin.

DETAILED DESCRIPTION OF THE INVENTION

Figure 1:
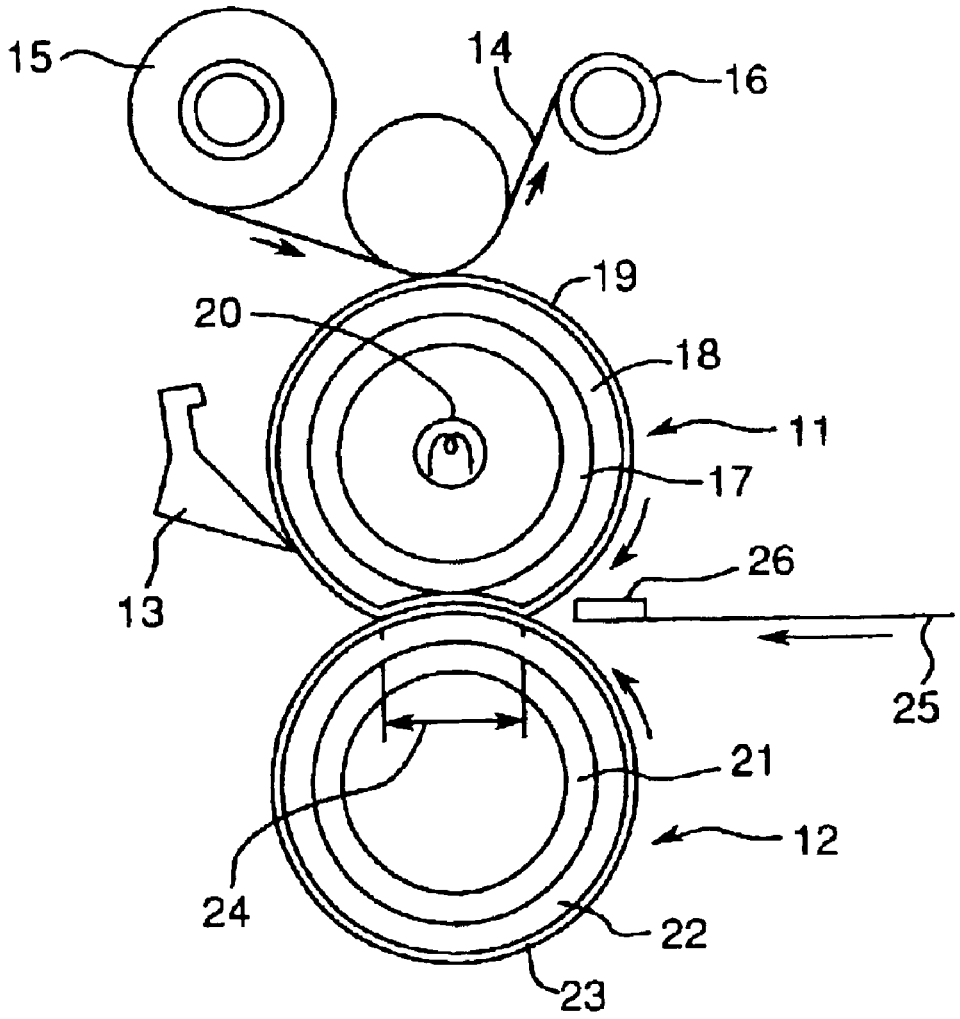
FIG. 1 is a schematic compositional view that shows an example of a fixing apparatus being suitable for using a toner of the present invention.

Toner particles, which constitute the toner for developing an electrostatic latent image of the present invention, comprise at least the binder resin, the colorant, the first wax and the second wax and the integrated domains of the first wax and the second wax are dispersed in the toner particle. In other words, the toner particle has a sea-island structure in the present invention and the first wax and the second wax were dispersed as an island component, while be integrated, in the binder resin being a main component (a sea component) of the toner particle.

In the present invention, it is suitable that the average dispersion particle size of the wax domain is within the range of 0.5 to 3.0 μm, preferably 0.7 to 2.7 μm, more preferably 0.8 to 2.5 μm. The present invention does not prevent the toner particle from comprising three or more kinds of waxes. In that case, the three or more kinds of waxes should be integrated to form the domain and the average dispersion particle size of its domain should be in the range mentioned above.

As the average dispersion particle size of the wax domain, the present specification uses the value obtained by the following method: The toner particle is sliced with a microtome, and then a photograph of the sliced sample is taken at 10000 magnifications by means of TEM (transmission electron microscope). The photographic image is taken in an image analyzer (Luzex 5000; manufactured by Nireco Corporation), and a distribution of particle size for the dispersion particle size is measured. However, the average dispersion particle size is not necessarily measured only by the above-mentioned method. Any method may be adopted as long as the average dispersion particle size of the dispersed particles in the toner particle can be measured. In the above-mentioned method, when the dispersed particle is not a perfect sphere, a particle size of circle equal to a cross-sectional area of its particle is calculated.

A formation of the integrated domain of plural kinds of waxes can be confirmed by observing that each wax domain is constituted from plural regions, being different in a crystal structure on the basis of the difference of the kind of the waxes, in the photographic image which is obtained by slicing the toner particle with a microtome and then taking a photograph of the sliced sample at 10000 magnifications by means of TEM.

In present invention, the toner particles in which such domains are formed can comprise a comparatively large amount of wax and hardly comprise liberating waxes. Therefore, it is thinkable that the toner can maintain excellent maintenance of heat resistance and anti-filming properties, with sufficiently showing the effects of improvements for toner properties by means of adding wax, i.e., the effects of improvements for anti-offset properties, separabilities between a fixing member (a heat member and/or a press member) and a recording sheet, low-temperature fixabilities, and smear-preventive properties. At the time of fixing a toner image, in a conventional toner particle, a comparatively large number of wax-fine particles need to transfer to the surface of the toner particle individually, but, in a toner particle of the present invention, the wax is dispersed in a comparatively large particle size as a domain so that the wax can efficiently transfer to the surface of the toner particle in an instant. It is thinkable that this matter is also one of the causes for which the effects of improvements for toner properties by means of adding wax can be shown sufficiently.

The first wax used in the present invention is the publicly known wax in the field of the toner for developing an electrostatic latent image, which has an incompatible property to the binder resin. For example, polyolefin wax, such as polyethylene wax and polypropylene wax, acid-modified wax, such as oxidized-type polyethylene wax and oxidized-type polypropylene wax, natural wax, such as carnauba wax and rice wax, montan wax, Fischer-Tropsch wax, paraffin wax and polymer alcohol wax and the like can be mentioned.

The acid-modified wax can be prepared by making polyolefin such as polyethylene and polypropylene additionally react with an acid monomer having a carboxyl group and a polymerizable double bond. As the acid monomer, one or more kinds of monomers selected from the group consisting of acrylic acid, methacrylic acid, maleic acid and maleic acid anhydride can be used. It is suitable that the acid value of the acid-modified wax is within the range of 1 to 60 KOHmg/g, preferably 3 to 30 KOHmg/g.

The second wax is the publicly known wax having an incompatible property to the binder resin, whose kind is different from that of the first wax used together. As concrete example, the same waxes as in the first wax mentioned above can be mentioned. Here, "kind is different" means that at least one item selected from a material (a substance name) and a DSC peak temperature is different. As a result, it is preferable that the second wax also has an incompatible property to the binder resin.

In the toner of the present invention, improvements of toner properties by means of adding wax are remarkable as compared with those in the conventional toner. The first wax and the second wax used and the toner properties remarkably improved are explained in detail by using the following aspects (A) to (C).

(A) In present invention, for example, when the first wax and the second wax satisfied with the relation of the following formula (A1);

$$T_1<Tm<T_2 \quad \text{(A1)}$$

for the DSC peak temperature ($T_1$(° C.)) of the first wax, the DSC peak temperature ($T_2$(° C.)) of the second wax and the softening point (Tm(° C.)) of the toner particles are used, the toner whose anti-offset properties and separabilities between a fixing member (a heat member and/or a press member) and a recording sheet are remarkably improved and whose maintenance of heat resistance and anti-filming properties are also sufficiently excellent can be prepared in comparison with the conventional toner in which these waxes are simply finely-dispersed. Such a toner of the present invention shows remarkably excellent anti-offset properties and separabilities, in particular, even when the full-color image is formed or the fixation is performed by using the fixing apparatus, being severe for toner, as shown in FIG. 1 described below. Moreover, an image loss does not arise due to marks which occur by a separating pick at the time of fixing.

As for the first wax and-the second wax satisfied with the above formula (A1), it is desirable that the first wax has a DSC peak temperature of 65 to 105° C., preferably 75 to 95° C. Further, it is desirable that its material is polyethylene wax, oxidized-type polyethylene wax, paraffin wax, carnauba wax, rice wax, montan wax, Fischer-Tropsch wax, and polymer alcohol wax and the like. As such a first wax, PW400 (polyethylene wax; manufactured by Toyo-Petrolite Co., Ltd.), H803 (paraffin wax; manufactured by Chukyo Yushi Co., Ltd.), PW655 (polyethylene wax; manufactured by Toyo-Petrolite Co., Ltd.), which are commercially available, can be used.

It is desirable that the second wax has a DSC peak temperature of 110 to 160° C., preferably 120 to 145° C. Further, it is desirable that its material is polyethylene wax, oxidized-type polyethylene wax, polypropylene wax and oxidized-type polypropylene wax, and the like. As such a second wax, 660P (polypropylene wax; manufactured by Sanyo Chemical Industries, Ltd.), PW1000 (polyethylene wax; manufactured by Toyo-Petrolite Co., Ltd.), 440P (polypropylene wax; manufactured by Sanyo Chemical Industries, Ltd.), 100TS (oxidized-type polypropylene wax; manufactured by Sanyo Chemical Industries, Ltd.), which are commercially available, can be used.

(B) In present invention, for example, when the first wax and the second wax satisfied with the relation of the following formula (B1);

$$T_1<Tm \text{ and } T_2<Tm \quad (B1),$$

preferably the relation of the following formula (B2);

$$T_1<T_2<Tm \quad (B2)$$

for $T_1$(° C.)), $T_2$(° C.) and Tm(° C.) are used, the toner whose anti-offset properties, separabilities between a fixing member (a heat member and/or a press member) and a recording sheet, and low-temperature fixabilities are remarkably improved and whose maintenance of heat resistance and anti-filming properties are also sufficiently excellent can be prepared in comparison with the conventional toner in which these waxes are simply finely-dispersed.

As for the first wax and the second wax satisfied with the above formulae (B1) to (B2), it is desirable that the first wax has a DSC peak temperature of 65 to 85° C., preferably 65 to 80° C. Further, it is desirable that its material is paraffin wax, carnauba wax, rice wax, montan wax, Fischer-Tropsch wax, polyethylene wax and oxidized-type polyethylene wax, and the like. As such a first wax, PW400 (polyethylene wax; manufactured by Toyo-Petrolite Co., Ltd.), H803 (paraffin wax; manufactured by Chukyo Yushi Co., Ltd.), HNP-9 (natural petroleum paraffin; manufactured by Nippon Seiro Co., Ltd.), which are commercially available, can be used.

It is desirable that the second wax has a DSC peak temperature of 90 to 130° C., preferably 95 to 120° C. Further, it is desirable that its material is polyethylene wax, oxidized-type polyethylene wax and polymer alcohol wax, and the like. As such a second wax, PW1000 (polyethylene wax; manufactured by Toyo-Petrolite Co., Ltd.), Unilin700 (polymer alcohol wax; manufactured by Toyo-Petrolite Co., Ltd.), PW655 (polyethylene wax; manufactured by Toyo-Petrolite Co., Ltd.), LAOS (oxidized-type polyethylene wax; manufactured by Yasuhara Chemical Co., Ltd.), which are commercially available, can be used.

(C) In present invention, for example, when the first wax and the second wax satisfied with the relation of the following formula (C1);

$$Tm<T_1 \text{ and } Tm<T_2 \quad (C1),$$

preferably the relation of the following formula (C2);

$$Tm<T_1<T_2 \quad (C2)$$

for $T_1$(° C.)), $T_2$(° C.) and Tm(° C.) are used, the toner whose anti-offset properties, separabilities between a fixing member (a heat member and/or a press member) and a recording sheet, and smear-preventive properties are remarkably improved and whose maintenance of heat resistance and anti-filming properties are also sufficiently excellent can be prepared in comparison with the conventional toner in which these waxes are simply finely-dispersed.

As for the first wax and the second wax satisfied with the above formulae (C1) to (C2), it is desirable that the first wax has a DSC peak temperature of 110 to 140° C., preferably 115 to 135° C. Further, it is desirable that its material is polyethylene wax and oxidized-type polyethylene wax, and the like. As such a first wax, 800P (polyethylene wax; manufactured by Mitsui Chemicals, Inc.), 4051E (oxidized-type polyethylene wax; manufactured by Mitsui Chemicals, Inc.), 405MP (oxidized-type polyethylene wax; manufactured by Mitsui Chemicals, Inc.), PW1000 (polyethylene wax; manufactured by Toyo-Petrolite Co., Ltd.), which are commercially available, can be used.

It is desirable that the second wax has a DSC peak temperature of 130 to 160° C., preferably 140 to 155° C. Further, it is desirable that its material is polypropylene wax and oxidized-type polypropylene wax, and the like. As such a second wax, 660P (polypropylene wax; manufactured by Sanyo Chemical Industries, Ltd.), 330P (polypropylene wax; manufactured by Sanyo Chemical Industries, Ltd.), 100TS (oxidized-type polypropylene wax; manufactured by Sanyo Chemical Industries, Ltd.), which are commercially available, can be used.

In any aspect of the aspects (A) to (C) mentioned above, it is desirable that at least one wax of the first wax and the second wax is acid-modified wax (oxidized-type polypropylene wax or oxidized-type polyethylene wax). Separation of the wax domains can effectively be prevented by using acid-modified wax and, therefore, the effects of improvements for toner properties by means of adding the wax can effectively be obtained.

The first wax and/or the second wax may be added at the time of mixing toner materials, such as the binder resin and the colorant, and the like. However, it is preferable that at least one wax of the first wax and the second wax is added at the time of synthesizing the binder resin. When at least one wax of the first wax and the second wax is internally added in the binder resin in advance, the formation of domains having an uniform diameter becomes easy and the effects of improvements for toner properties by means of adding the wax can effectively be obtained.

In any aspect mentioned above, it is suitable that the total amount of the first wax and the second wax to be added is within the range of 3 to 15 parts by weight, preferably 4 to 10 parts by weight with respect to 100 parts by weight of the binder resin. More preferably, the amount of the first wax to be added is within the range of 2.5 to 10 parts by weight and the amount of the second wax to be added is within the range of 0.5 to 5 parts by weight. In particular, when the first wax and the second wax are filled in a large amount, in other words, the total amount of their waxes to be added is 5 or more parts by weight with respect to 100 parts by weight of the binder resin, it is preferable that at least one wax of the first wax and the second wax is added at the time of synthesizing the binder resin as described above. When the toner particles of the present invention comprise three or more kinds of waxes, the total amount of all waxes to be added may be within the range mentioned above.

The binder resin used in the present invention is not particularly restricted. As the binder resin, binder resins which are publicly known in the field of the toner for developing the electrostatic latent image, such as polyester resin, (meth)acrylic resin, styrene-(meth)acrylic copolymer resin, epoxy resin, COC (cyclic olefin resin; e.g. TOPAS-COC (manufactured by Ticona Inc.)) and the like are exemplified. In the case of using a fixing apparatus wherein an oil-coating is not required at the time of fixing or a very small amount of an oil is required at the time of fixing, it is particularly preferable to use polyester resin.

As the polyester resin, a polyester resin which is prepared by polycondensing a polyhydric alcohol component and a polycarboxylic acid component can be used in the present invention.

Among polyhydric alcohol components, examples of dihydric alcohol components include: bisphenol A-alkylene oxide adducts, such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane and polyoxyethylene(2,0)-2,2-bis(4-hydroxyphenyl)propane, ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polytetramethylene glycol, bisphenol A, hydrogenized bisphenol A, etc.

Examples of trihydric or more alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene, etc.

Among polycarboxylic acid components, examples of dicarboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenylsuccinic acid, isooctenyl succinic acid, n-octyl succinic acid, isooctyl succinic acid, and anhydrides or lower alkyl esters of these acids.

Examples of tri- or higher polycarboxylic acid components include 1,2,4-benzenetricarboxylic acid (trimellitic acid), 1,2,5-benzenetricarboxylic acid, 2,5,7-naphthalenetricarboxylic acid, 1,2,4-cyclohexanetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, empol trimer acid, anhydrides and lower alkyl esters of these acids.

In the present invention, with respect to the polyester resin, a monomeric material for a polyester resin, a monomeric material for a vinyl resin and a monomer that reacts with both of these monomeric materials are used, and a polycondensation reaction for obtaining the polyester resin and a radical polymerization reaction for obtaining the vinyl resin are carried out in parallel in the same reaction vessel; and resins thus obtained may be preferably used. The monomer that reacts with both of these monomeric materials is, in other words, a monomer that can be used in both a polycondensating reaction and a radical polymerization reaction. That is, the monomer has a carboxyl group that undergoes a polycondensating reaction and a vinyl group that undergoes a radical polymerization reaction. Examples thereof include fumaric acid, maleic acid, acrylic acid, methacrylic acid, etc.

Examples of the monomeric materials for polyester resins include the above-mentioned polyhydric alcohol components and polycarboxylic acid components.

Examples of the monomeric materials for vinyl resins include: styrene or styrene derivatives, such as o-methylstyrene, m-methylstyrene, p-methylstyrene, α-methylstyrene, p-ethylstyrene, 2,4-dimethylstyrene, p-tert-butylstyrene and p-chlorostyrene; ethylene unsaturated monoolefins, such as ethylene, propylene, butylene and isobutylene; methacrylic acid alkyl esters, such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate and dodecyl methacrylate; acrylic acid alkyl esters, such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, hexyl acrylate, octyl acrylate, nonyl acrylate, decyl acrylate, undecyl acrylate, and dodecyl acrylate; unsaturated carboxylic acids, such as acrylic acid, methacrylic acid, itaconic acid and maleic acid; acrylonitrile, maleic acid ester, itaconic acid ester, vinyl chloride, vinyl acetate, vinyl benzoate, vinyl methyl ethyl ketone, vinyl hexyl ketone, vinyl methyl ether, vinyl ethyl ether, and vinyl isobutyl ether. Examples of polymerization initiators used when the monomeric materials for vinyl resins are polymerized include azo or diazo polymerization initiators such as 2,2'-azobis(2,4-dimethylvaleronitrile), 2,2'-azobisisobutyronitrile, 1,1'-azobis(cyclohexane-1-carbonitrile) and 2,2'-azobis-4-methoxy-2,4-dimethylvaleronitrile and peroxide polymerization initiators such as benzoyl peroxide, methyl ethyl ketone peroxide, isopropylperoxycarbonate and lauroyl peroxide.

It is desirable that the binder resin has an acid value of 5 to 50 KOHmg/g, preferably 10 to 40 KOHmg/g. Particularly, by using the polyester resin having said acid value, it is possible to improve the dispersibilities of carbon black, various kinds of colorants and the like, and to prepare the toner having a sufficient electrification amount.

In the present invention, it is preferable to use two kinds of polyester resins having different softening points, particularly, to use the first polyester resin having a softening point of 80 to 120° C. and the second polyester resin having a softening point of 120 to 160° C. in order to further improve low-temperature fixabilities and anti-offset properties as a toner for an oil-less fixing in particular. More preferably, the first polyester resin has a softening point of 90 to 115° C. and the second polyester resin has a softening point of 125 to 150° C. From the viewpoint of further improving a heat resistance of a toner, it is desirable that the glass transition points of the first and second polyester resins are 50 to 75° C., preferably 55 to 70° C. In the case of using two kinds of binder resins as a binder resin in such a manner, the acid value of the mixed resins may be within the range mentioned above.

As for the first polyester resin, it is preferable to employ the polyester resin prepared by polycondensing the aforesaid polyhydric alcohol component and polycarboxylic acid component, in particular the polyester resin which is prepared by employing a bisphenol A-alkylene oxide adduct as a main polyhydric alcohol component and at least one carboxylic acid as a main polycarboxylic acid component, said carboxylic acid being selected from a group consisting of terephthalic acid and fumaric acid. It is desirable that the first polyester resin has a Mn of 1800 to 7300, preferably 2000 to 5000, and a Mw/Mn of 1.7 to 4.6, preferably 2 to 4.

As for the second polyester resin, it is preferable to employ the polyester resin prepared by polycondensing the monomer component comprising at least the aforesaid trihydric or more alcohol component and/or tri- or higher polycarboxylic acid component, in particular the polyester resin which is prepared by employing a bisphenol A-alkylene oxide adduct as a main dihydric alcohol component, a trimellitic acid as a tri- or higher polycarboxylic acid component and at least one carboxylic acid as a main dicarboxylic acid component, said carboxylic acid being selected from a group consisting of terephthalic acid, fumaric acid and dodecenyl succinic acid.

Moreover, As for the second polyester resin, it is possible to employ the polyester resin which is prepared by charging a mixture of a monomeric material for a polyester resin, a monomeric material for a vinyl resin and a monomer that reacts with both of these monomeric materials into the same reaction vessel, and then carrying out in parallel a polycondensation reaction for obtaining the polyester resin and a radical polymerization reaction for obtaining the vinyl resin. Such a resin is preferable from the viewpoint of improving dispersibilities of the wax as well as the toughness, fixability and anti-offset properties of the toner. In this case, it is desirable that the content of the vinyl resin in the second polyester resin is within the range of 5 to 30% by weight, preferably 10 to 25% by weight.

It is desirable that the sencond polyester resin has a Mn of 2000 to 8500, preferably 2500 to 6000, and a Mw/Mn of 8 to 40, preferably 15 to 40.

It is preferable that the second polyester resin as mentioned above comprises the components insoluble in tetrahydrofuran (THF) from the viewpoint of anti-offset properties at high temperature. From such a viewpoint, it is preferable to employ the first and second polyester resins as the content of the THF insoluble components in the binder resin is 0.5 to 30% by weight, preferably 5 to 20% by weight.

From the viewpoint of further improvements of low-temperature fixabilities and anti-offset properties, it is desirable that the weight ratio of the first polyester resin to the second polyester resin is 65:35 to 30:70, preferably 60:40 to 35:65 in the case where the prepared toner is employed as a full-color toner, and is 20:80 to 50:50, preferably 25:75 to 40:60 in the case where the toner is employed as a monochrome toner.

In order to internally add at least one wax of the first wax and the second wax in the binder resin in advance, a synthesis of the binder resin may be performed under the condition where at least one wax of the first wax and the second wax is added in the monomers for synthesizing the binder resin. In particular, when the first polyester resin (low molecular weight type resin) and the second polyester resin (high molecular weight type resin) mentioned above are employed in combination as a binder resin, it is preferable to add at least one wax of the first wax and the second wax in advance at the time of synthesizing the second polyester resin, because the second polyester resin is hard to be entered by the wax in comparison with the first polyester resin. Concretely, a polycondensation reaction (and, if necessary, a radical polymerization reaction) may be carried out under the condition where the wax is added in the acid monomer and the alcohol monomer constituting the polyester resin (and the monomeric material for the vinyl resin used if necessary).

As the colorant used in the present invention, the publicly known pigments and dyes which have conventionally been used as a colorant for a toner for developing an electrostatic latent image may be employed. The following pigments and dyes are exemplified: carbon black, aniline blue, chalcoyl blue, chrome yellow, ultramarine blue, Du Point oil red, quinoline yellow, methylene blue chloride, copper phthalocyanine blue, malachite green oxalate, lamp black, rose bengal, C.I. pigment red 48:1, C.I. pigment red 122, C.I. pigment red 57:1, C.I. pigment red 184, C.I. pigment yellow 97, C.I. pigment yellow 12, C.I. pigment yellow 17, C.I. solvent yellow 162, C.I. pigment yellow 180, C.I. pigment yellow 185, C.I. pigment blue 15:1, C.I. pigment blue 15:3, and the like. The content of the colorant is preferably within the range of 2 to 15 parts by weight with respect to 100 parts by weight of the binder resin.

The toner of the present invention preferably comprises a wax dispersing agent. By adding the wax dispersing agent, adhesive properties of the wax domains to the binder resin can be improved and the effect of preventing a liberation (separation) of the wax domains is improved.

The wax dispersing agent may be a graft polymer prepared by grafting a polyolefin with a vinyl monomer, in detail, a graft polymer in which the polyolefin as a main chain has a vinyl polymer chain comprising the vinyl monomer as a side chain.

Such a graft polymer can be synthesized by the publicly known method. For example, the polyolefin is dissolved to the suitable organic solvent in an autoclave reaction vessel and thereto nitrogen gas is introduced. While the obtained solution is heated, thereto the mixed solution of the vinyl monomer and the suitable polymerization initiator is then dropped in order to polymerize and a desolvation is carried out.

As for the polyolefin, it is possible to preferably use waxes, such as paraffin wax, paraffin latex and microcrystalline wax and the like, in particular, polyethylene wax and polypropylene wax. These waxes may be used alone or in combination. The content of polyolefin in the above-mentioned graft polymer is preferably 10 to 60% by weight, more preferably 10 to 40% by weight.

As for the vinyl monomer, styrene series monomer, such as styrene and alkylstyrene (e.g. ($\alpha$-methylstyrene, p-methylstyrene and the like); (meth)acryl series monomer, for example, alkyl (meth)acrylate in which the alkyl group has a carbon number of 1 to 18, such as methyl (meth) acrylate, ethyl (meth)acrylate, butyl (meth)acrylate, 2-ethylhexyl (meth)acrylate, lauryl (meth)acrylate and stearyl (meth)acrylate, hydroxyl group-containing (meth) acrylate, such as hydroxyl (meth)acrylate and hydroxypropyl (meth)acrylate, amino group-containing (meth)acrylate, such as diethylaminoetyl (meth)acrylate, and (meth)acrylic acid; acrylonitrile, methacrylonitrile, and mono-, or di-alkyl maleate and the like are exemplified. These monomers may be used alone or in combination.

When the binder resin is polyester resin, it is preferable to use acrylonitrile as a vinyl monomer constituting the graft polymer from the viewpoint of improving adhesive properties of the wax domains to the polyester resin. Moreover, when the binder resin obtained by using the high molecular weight type resin and the low molecular weight type resin in combination is used as a binder resin, the high molecular weight type resin has low adhesive properties of the wax domains in comparison with the low molecular weight type resin so that it is preferable to add the graft polymer.

It is preferable to add the graft polymer in an amount of 0.1 to 15 parts by weight with respect to 100 parts by weight of the binder resin.

Moreover, the toner of the present invention preferably comprises a polymer (B) having a weight-average molecular weight (Mw) of 1000 to 3000, preferably 1000 to 2800, and a ratio of Mw/Mn (wherein Mn is a number-average molecular weight) of 2.0 or less, preferably 1.0 to 2.0. When the polymer (B) is used, the polymer (B) forms the surfaces by being ground in a manufacturing process and, as a result, the polymer (B) is exposed on the surfaces of the toner particles so that not only mentainence of heat resistance and anti-filming properties of the toner are further improved, but also the separation of the wax domains can more effectively be prevented. Furthermore, a load of a grinder is decreased in a grinding step at the time of manufacturing a toner and, as a result, a manufacturing efficiency of the toner is improved.

It is desirable that the glass transition point (Tg) of the polymer (B) is not less than 50° C., preferably 55 to 85° C., more preferably 60 to 80° C. It is desirable that the softening point of the polymer (B) is 110 to 150° C., preferably 120 to 145° C.

As to the polymer (B), homopolymers or copolymers of the publicly known aromatic monomers and/or aliphatic monomers may be employed.

As the aromatic monomer, styrene monomers represented by the following formula (1) and indene monomers represented by the following formula (2) are exemplified:

(1)

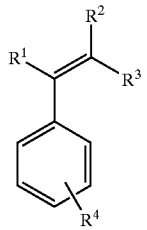

(wherein $R^1$, $R^2$, $R^3$ and $R^4$ indicate independently hydrogen atom, halogen atom or $C_1$–$C_4$-alkyl groups, such as methyl group, ethyl group, n-propyl group or n-butyl group, preferably hydrogen atom, chlorine atom, bromine atom or methyl group.)

(2)

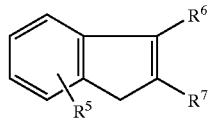

(wherein $R^5$, $R^6$ and $R^7$ indicate independently hydrogen atom, halogen atom or $C_1$–$C_6$-alkyl groups, such as methyl group, ethyl group, n-propyl group or n-butyl group, n-pentyl group or n-hexyl group, preferably hydrogen atom, chlorine atom, bromine atom or methyl group.)

As examples of sytrene monomers, the following monomers are exemplified: styrene, vinyltoluene, α-methylstyrene, isopropenyltoluene, β-methylstyrene, 1-propenyltoluene, α-chlorostyrene, m-chlorostyrene, p-chlorostyrene, α-chlorostyrene,βP-chlorostyrene, o-bromostyrene, m-bromostyrene, p-bromostyrene, α-bromostyrene, β-bromostyrene, and the like. Preferable styrene monomers are styrene, vinyltoluene, α-methylstyrene, isopropenyltoluene, β-methylstyrene and 1-propenyltoluene, more preferably styrene, vinyltoluene, α-methylstyrene and isopropenyltoluene, in particular, styrene, α-methylstyrene and isopropenyltoluene.

As examples of indene monomers, indene, methylindene, ethylindene and the like can be mentioned. Among others, indene is particularly preferred.

The aromatic monomers may be employed alone or in combination.

Although the following monomers may be exemplified as the aliphatic monomers, they are not particularly restricted insofar that they can polymerize with the aforesaid aromatic monomers: diolefin monomers, such as isoprene, piperylene, 1,3-butadiene, 1,3-pentadiene, 1,5-hexadiene, 2,3-dimethyl-1,3-butadiene, chloroprene, 2-bromo-1,3-butadiene and the like; monoolefin monomers, such as ethylene, propylene, butylene, isobutylene, 2-methyl butene-1,2-methyl butene-2 and the like; alkyl acrylate monomers, such as methyl acrylate, ethyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, hexyl acrylate, octyl acrylate, nonyl acrylate, decyl acrylate, undecyl acrylate, dodecyl acrylate and the like; alkyl methacrylate monomers, such as methyl methacrylate, ethyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate, dodecyl methacrylate and the like; unsaturated carboxylic acids, such as acrylic acid, methacrylic acid, itaconic acid, maleic acid and the like; acrylonitrile, maleate, itconate, vinyl chloride, vinyl acetate, vinyl benzoate, vinyl methyl ethyl ketone, vinyl hexyl ketone, vinyl methyl ether, vinyl ethyl ether, vinyl isobutyl ether and the like. Preferable aliphatic monomers are monoolefin monomers and diolefin monomers, more preferably isoprene, piperylene, 2-methyl butene-1 and 2-methyl butene-2, in particular isoprene.

The aliphatic monomers may be employed alone or in combination.

Among the polymers (B) prepared by the aforementioned monomers, it is preferable to employ the polymer (B) which comprises at least styrene and/or α-methylstyrene as a constitutional unit. As examples of the polymer (B), polystyrene, poly-α-methylstyrene, styrene/α-methylstyrene copolymer, styrene/isopropenyltoluene copolymer, α-methylstyrene/isopropenyltoluene copolymer, α-methylstyrene/isopropenyltoluene/isoprene terpolymer, styrene/isopropenyltoluene/isoprene terpolymer and the like can be mentioned. Preferable polymer (B) is poly-α-methylstyrene or α-methylstyrene/isopropenyltoluene copolymer. Although a weight ratio of the monomers for preparing the polymer (B) is not particularly restricted, it is desirable to adjust the weight ratio in such a way that a ratio of styrene and/or α-methylstyrene to the whole monomers is 25 to 100% by weight, preferably 30 to 100% by weight.

It is desirable that the amount of the polymer (B) to be used is within the range of 1.5 to 25 parts by weight, preferably 2 to 15 parts by weight, more preferably 3 to 10 parts by weight with respect to 100 parts by weight of the binder resin. The polymer (B) may be in combination and, in that case, the total amount of their polymers (B) may be within the range mentioned above.

The toner of the present invention may comprise additives such as a charge-control agent and a magnetic material.

As the charge-control agent, the publicly known charge-control agents which have formerly been employed for controlling an electrifiability of the toner in the field of the toner for developing the electrostatic latent image can be used. For example, a fluorine surfactant, a metal-containing dye, such as a metal complex of salicylic acid and an azo metal compound and the like, a high molecular acid, such as a copolymer which contains maleic acid as a monomer component, a calix arene compound, a organic boron compound and the like may be employed.

The toner of the present invention can be obtained by a manufacturing method of a toner for developing an electrostatic latent image in which the binder resin, the colorant, the first wax and the second wax, and the other additives are melted and kneaded, the kneaded product is cooled and the cooled product is then ground and classified, wherein the kneading temperature is adjusted to not less than the softening point of the binder resin (° C.) (represented by "Bm" hereinafter in some cases)+30° C., preferably not less than Bm+30° C. and not more than Bm+120° C., more preferably not less than Bm+40° C. and not more than Bm+100° C. Moreover, it is desirable that the kneading temperature is within the range of 160 to 220° C., preferably 170 to 210° C. The first wax and/or the second wax may be used so as to be simultaneously mixed with toner materials, such as the binder resin and the colorant, or to be added at the time of synthesizing the binder resin in advance, as described above.

In the conventional technique for manufacturing a toner, by melting and kneading under a condition where the binder resin in the kneaded product has a moderately high viscosity, a shearing force is made to act on the binder resin, the melted wax is tore off by the melted binder resin and dispersibilities of the wax are improved. Therefore, the wax particles are finely dispersed in an average dispersion particle size of not more than about 0.5 μm in the binder resin.

In the present invention, the kneading temperature is adjusted to a comparatively high value as mentioned above and a melting and kneading is carried out under a condition where the binder resin in the kneaded product has such a low viscosity that a shearing force does not act on the binder resin at the time of melting and kneading. When the melting and kneading is carried out under such a condition, it becomes possible to add the wax in a high amount in the toner and the integrated domains of plural kinds of waxes are formed in a comparatively large average dispersion particle size. It is guessed that this matter is caused by the followings; The kneaded product (the melted binder resin) has a low viscosity so that each melted wax easily flows in the kneaded product and agglomerates in order to form the integrated domain. Furthermore, a shearing force does not act on so that the particle size of the domain becomes comparatively large.

In the present invention, the particle size of the wax domain in the toner particle can be controlled by changing the kneading temperature. When the kneading temperature is raised, the particle size of the wax domain in the obtained toner particle becomes large in general. When the kneading temperature is lowered, the particle size of the wax domain in the toner particle becomes small in general.

It is suitable that the toner has a volume average particle size of 4 to 10 μm, preferably 5 to 8 μm.

In the case of fixing the toner images comprising the toner of the present invention as mentioned above, it is suitable to employ a fixing method comprising an allowing a recording sheet (e.g. a sheet of paper) supporting toner images to pass through a contact section between a heating member and a pressing member or a pressing-heating member arranged with be contacted to the heating member. In particular, from the viewpoint of effectively achieving a separation of a sheet of paper from the heating member, it is preferable that a nip constitution of the contact section is convex in an upper direction. From the viewpoint of further improvement of separabilities between a sheet of paper and the heating member, it is preferable that the surface of the heating member is made from fluorine resin, such as PFA (tetrafluoroethylene-perfluoroalkyl vinyl ether copolymer), polytetrafluoroethylene, polyvinylidene fluoride and the like.

As a fixing apparatus employing such a fixing method, for example, the fixing apparatus shown schematically in FIG. 1 can preferably be used. The fixing apparatus shown in FIG. 1 has a heat roller 11 as a heating member and a press roller 12 as a pressing member. In detail, a heat roller 11, a press roller 12 contacted to the heat roller, a separating pick 13 for separating the fixed sheet from the heat roller, a cleaning web 14 for cleaning the surface on the heat roller, a webroller 15 around which the cleaning web is wound, and a wind-up roller 16 winding-up the cleaning web are provided. The heat roller 11 generally has an elastic member layer 18 and a surface layer 19 on an aluminum center core 17 and is provided with a heater 20 inside the aluminum center core. The press roller 12 generally has an elastic member layer 22 and a surface layer 23 on an aluminum center core 21. The material of the elastic member layers (18, 22) is not particularly restricted and the preferable material is silicone rubber. The material of the surface layers (19, 23) is not particularly restricted and the preferable material is fluorine resin, in particular, PFA.

In FIG. 1, a nip 24 having a convex shape in the side of the heat roller (the upper side) is formed at the contact section between the heat roller 11 and the press roller 12. The fixation is carried out by allowing a recording sheet 25 supporting a toner image 26 to pass through the contact section.

EXAMPLES

Production Examples of Resins 1 to 11

An alcohol component, an acid component and a polymerization initiator (dibutyltin oxide) were charged into the four-necked flask made of glass in a molar ratio shown in Table 1, said flask equipping with a thermometer, an agitator made of stainless, a reflux condensor and a tube for introducing nitrogen gas. The reaction was carried out by heating the mixture with a mantle heater under an atmosphere of nitrogen while said mixture was stirred. The progress of the reaction was pursued by measuring an acid value of the reaction mixture. When the acid value reached the prescribed value, the reaction was stopped and the reaction product was cooled to room temperature to obtain the polyester resins.

BPA-PO: bisphenol A-propylene oxide adducts
BPA-EO: bisphenol A-ethylene oxide adducts
TPA: terephthalic acid
TMA: trimellitic acid
DSA: dodecenyl succinic acid
St: styrene
BA: butyl acrylate

Production Example of Resin 12

Styrene and butyl acrylate (StAc monomer) were charged into a dropping funnel in a molar ratio shown in Table 1 together with dicumylperoxide as a polymerization initiator. Separately, an alcohol component and an acid component (PES monomer), dibutyltin oxide as a polymerization initiator, and polyethylene wax (PW400, manufactured by Toyo-Petrolite Co., Ltd., 7.5% by weight to the fed monomers) were charged into the four-necked flask made of glass in a molar ratio shown in Table 1, said flask equipping with a thermometer, an agitator made of stainless, a reflux condenser and a tube for introducing nitrogen gas. This flask was placed on a mantle heater. The solution was stirred at 160° C. under a nitrogen gas atmosphere, with styrene, etc. being dropped therein from the dropping funnel, and the addition polymerization reaction was then carried out for 2 hours while the temperature was maintained at 160° C. Thereafter, the obtained solution was heated to 230° C. and the condensation polymerization reaction was carried out to obtain the polyester resin 12. The weight ratio of the PES monomer to StAc monomer was 8:2.

Production Example of Resin 13

The polyester resin 13 was obtained by the same production method as that of production example of resin 12 except that polyethylene wax (PW400, manufactured by Toyo-Petrolite Co., Ltd.) was changed to polyethylene wax (800P, manufactured by Mitsui Chemicals, Inc.).

The monomer ratio and the physical properties of the resins 1 to 13 obtained by the production methods mentioned above were shown in Table 1 and Table 2. Each polyester resin was coarsely ground (≦1 mm), and used in the following preparing method of toner.

TABLE 1

| | PES | | | | | | | | | |
|---|---|---|---|---|---|---|---|---|---|---|
| | | | | | | Fumaric | StAc | | PES/ | |
| | BPA-PO | BPA-EO | TPA | TMA | DSA | Acid | St | BA | StAc | Remarks |
| Resin 1 | 7 | 3 | 4 | 5 | 4 | 0 | — | — | — | — |
| Resin 2 | 9 | 1 | 2 | 0 | 0 | 9 | — | — | — | — |
| Resin 3 | 7 | 3 | 7 | 2 | 0 | 0 | — | — | — | — |
| Resin 4 | 9 | 2 | 4 | 0 | 0 | 5 | — | — | — | — |
| Resin 5 | 7 | 4 | 5 | 0 | 0 | 5 | — | — | — | — |
| Resin 6 | 5 | 5 | 0 | 5 | 0 | 7 | — | — | — | — |
| Resin 7 | 9 | 1 | 8 | 0 | 0 | 0 | — | — | — | — |
| Resin 8 | 8 | 2 | 0 | 7 | 0 | 5 | — | — | — | — |
| Resin 9 | 9 | 1 | 8 | 0 | 0 | 1 | — | — | — | — |
| Resin 10 | 7 | 3 | 0 | 5 | 0 | 4 | — | — | — | — |
| Resin 11 | 8 | 2 | 8 | 0 | 0 | 0 | — | — | — | — |
| Resin 12 | 7 | 3 | 4 | 4 | 4 | 1 | 20 | 2.5 | 8/2 | PW400: 7.5% |
| Resin 13 | 7 | 3 | 4 | 4 | 4 | 1 | 20 | 2.5 | 8/2 | 800P: 7.5% |

TABLE 2

| | Mn | Mw/Mn | Tg (° C.) | Tm (° C.) | Acid Value (KOH mg/g) | Hydroxyl Value (KOH mg/g) | Insoluble components in THF (%) |
|---|---|---|---|---|---|---|---|
| Resin 1 | 2500 | 29.0 | 62.0 | 136.7 | 15.0 | 18.5 | 15.0 |
| Resin 2 | 2000 | 2.5 | 62.5 | 95.5 | 30.3 | 20.0 | — |
| Resin 3 | 5400 | 14.7 | 62.4 | 125.3 | 5.0 | 41.0 | 15.1 |
| Resin 4 | 5600 | 3.1 | 65.4 | 92.8 | 4.2 | 18.2 | — |
| Resin 5 | 3200 | 3.4 | 57.0 | 95.0 | 6.0 | 29.1 | — |
| Resin 6 | 2780 | 31.0 | 60.2 | 130.8 | 27.9 | 17.6 | 22.0 |
| Resin 7 | 1920 | 2.4 | 57.1 | 83.4 | 9.6 | 24.1 | — |
| Resin 8 | 2830 | 18.9 | 65.4 | 140.9 | 34.0 | 16.5 | 20.2 |
| Resin 9 | 2120 | 2.5 | 59.6 | 90.8 | 13.6 | 18.0 | — |
| Resin 10 | 3030 | 10.2 | 53.6 | 139.1 | 31.0 | 14.5 | 21.5 |
| Resin 11 | 1890 | 2.5 | 55.1 | 91.5 | 13.9 | 17.5 | — |
| Resin 12 | 2450 | 29.0 | 65.0 | 133.1 | 18.1 | 18.7 | 16.7 |
| Resin 13 | 2430 | 28.5 | 64.5 | 133.3 | 19.0 | 19.0 | 15.9 |

(Wax)

The waxes used in the present examples were shown in Table 3.

TABLE 3

| Trade Name | Manufacturer | Component | Remarks |
|---|---|---|---|
| H803 | Chukyo Yushi Co., Ltd. | Paraffin wax | — |
| HNP-9 | Nippon Seiro Co., Ltd. | Natural petroleum paraffin | — |
| PW400 | Toyo-Petrolite Co., Ltd. | Polyethylene wax | — |
| PW655 | Toyo-Petrolite Co., Ltd. | Polyethylene wax | — |
| Unilin 700 | Toyo-Petrolite Co., Ltd. | Long-chain alcohol | — |
| PW1000 | Toyo-Petrolite Co., Ltd. | Polyethylene wax | — |
| LA05 | Yasuhara Chemical Co., Ltd. | Polyethylene wax | Acid-modified (Acid Value 55) |
| 660P | Sanyo Chemical Industries, Ltd. | Polypropylene wax | — |
| 100TS | Sanyo Chemical Industries, Ltd. | Polypropylene wax | Acid-modified (Acid Value 3.5) |
| 440P | Sanyo Chemical Industries, Ltd. | Polypropylene wax | — |
| 4051E | Mitsui Chemicals, Inc. | Polyethylene wax | Acid-modified (Acid Value 12.0) |
| 405MP | Mitsui Chemicals, Inc. | Polyethylene wax | Acid-modified (Acid Value 1.0) |
| 800P | Mitsui Chemicals, Inc. | Polyethylene wax | — |
| 330P | Sanyo Chemical Industries, Ltd. | Polypropylene wax | — |

Production Example of Polymer B1

α-Methylstyrene (purity: 99.8%)(500 g) and toluene (500 g) were charged into the three-necked flask, and boron trifluoride phenol complex was added to the mixture little by little with stirring. Then the reaction was carried out for three hours at 20° C. while the obtained mixture was cooled in the Dry Ice/acetone bath. Alkali was added to the reaction mixture to carry out the deactivation of the catalyst and the alkali was removed. The concentration was carried out to remove the solvent and the unreacted monomer and poly- α-methylstyrene was obtained. The poly-α-methylstyrene is referred to as polymer B1.

Production Example of Polymer B2

α-Methylstyrene (purity: 99.8%)(250 g), isopropenyl toluene (250 g) and toluene (500 g) were charged into the three-necked flask, and boron trifluoride phenol complex was added to the mixture little by little with stirring. Then the reaction was carried out for three hours at 20° C. while the obtained mixture was cooled in the Dry Ice/acetone bath. Alkali was added to the reaction mixture to carry out the deactivation of the catalyst and the alkali was removed. The concentration was carried out to remove the solvent and the unreacted monomer styrene monomer/aromatic monomer copolymer was obtained. The copolymer is referred to as polymer B2.

The physical properties of the polymers B1 and B2 obtained by the above-mentioned production method are shown in Table 4.

TABLE 4

| | | Mw | Mw/Mn | Tg (° C.) | Tm (° C.) |
|---|---|---|---|---|---|
| Polymer B1 | Poly-α-methyl-styrene | 2760 | 1.83 | 75 | 140 |
| Polymer B2 | α-Methylstyrene-isopropenyl-toluene copolymer | 2040 | 1.62 | 75 | 110 |

Production Example of Wax Dispersing Agent A

Xylene of 600 parts, low molecular weight polypropylene 660P (manufactured by Sanyo Chemical Industries, Ltd.) of 480 parts and low molecular weight polyethylene PW400 (manufactured by Toyo-Petrolite Co., Ltd.) of 120 parts were charged into an autoclave reaction vessel equipping with a thermometer and an agitator in order to carry out dissolution sufficiently and thereto nitrogen gas is introduced. To the mixture the mixed solution of styrene of 1992 parts, acrylonitrile of 168 parts, monobutyl maleate of 240 parts, di-t-butyl peroxyhexahydroterephthalate of 78 parts and xylene of 455 parts was dropped for 3 hours at 175° C. in order to polymerize, and the obtained mixture was kept for additional 30 minutes at that temperature. The desolvation was carried out to obtain the wax dispersing agent A.

Experimental Example A

Example A1

When a toner was prepared, the resin obtained by dry-blending the resin 1 and the resin 2 in a weight ratio of 60:40 by means of Henschel mixer was used as a binder resin. The blended resin and a magenta pigment (C.I. Pigment Red 184) were charged into a press kneader in a weight ratio (resin:pigment) of 7:3, and the mixture was kneaded. After cooling, the kneaded product was ground by means of the feather mill to obtain the pigment master batch. The binder resin and the pigment master batch mentioned above were used in such a way that the weight ratio (binder resin:pigment) was 100:4. WAX1 and WAX2 shown in Table 5 was respectively added to this blend in amounts of 4.5 parts by weight and 1.0 parts by weight with respect to 100 parts by weight of the binder resin, and the mixture obtained was mixed by means of Henschel mixer, and then the mixture was kneaded by means of the twin-extruding kneader (PCM-30, manufactured by Ikegai Tekko K.K.) at a kneading temperature of 180° C. The kneaded product was cooled and then coarsely ground by means of the feather mill. Then the coarsely ground product was subjected to a grinding treatment by means of the mechanical grinder A (Criptron grinder, manufactured by Kawasaki Heavy Industries Ltd.) and the ground product obtained was further subjected to a finely grinding treatment by means of the circulating grinder B (Jet mill grinder, manufactured by Nippon Pneumatic K.K.). The finely ground product was classified by means of the mechanical classifier C (ATP classifier, manufactured by Alpine Inc.) and the classification was carried out yet again in the same manner to obtain a toner having a volume-average particle size of about 7 μm. Then hydrophobic silica (manufactured by Hoechst Japan K.K.; H2000) of 0.9% by weight, hydrophobic titania (manufactured by Titan Kogyo K.K.; STT30A) of 0.9% by weight and strontium titanate of 2.5% by weight were added to the toner particles and the mixture was subjected to a mixing treatment by means of Henschel mixer in order to obtain a magenta toner.

Examples A2 to A14 and Comparative Examples A1 to A3

The toners were obtained by the same preparation method as that described in example A1 except that various materials were used in such a way that the toner composition shown in Table 5 was achieved and the kneading temperature was adjusted to the value shown in Table 6.

As for various items described below, the obtained toners were evaluated, and the evaluation results were shown in Table 6.

(Wax Domain Diameter)

The toner particle was sliced with a microtome, and then a photograph of the sliced sample was taken at 10000 magnifications by means of TEM (transmission electron microscope). The photographic image was taken in an image analyzer (Luzex 5000; manufactured by Nireco Corporation), and a distribution of particle size for the domain diameter was measured. When the domain was not a perfect sphere, a particle size of circle equal to a cross-sectional area of its domain was calculated.

(Heat Resistance)

The toner (10 g) was left at a high temperature of 50° C. for 24 hours and then the evaluation was carried out by visually confirming the toner.

○: Cohered toner was not found, and a practical problem was not brought about.

Δ: Although a weakly cohered mass was found, it was gotten loose immediately with a weak force, and a practical problem was not brought about.

x: A strongly cohered mass was found, and said mass was not easily gotten loose, and a practical problem was brought about.

(Separabilities/Anti-Offset Properties)

In consideration of the toner-coating mass in the case when three-color toner images were overlapped, a zonal solid image (toner-coating mass of 12 g/m$^2$) having a width of 36 mm was printed at the 5 mm region from the upper edge in the lengthwise direction on a sheet of A4 size paper in order to form a non-fixed image. This non-fixed image was fixed at various fixing temperatures by using the following fixing apparatus 1 and 2 and a separable/non-offset temperature range was measured. The temperature range is referred to as the range of the fixing temperature at which a separation of paper from a heat roller is preferably carried out and an offset phenomenon does not occur.

The fixing apparatus 1 is an apparatus shown in FIG. 1, belonging to a soft roller type having a construction of fluorine surface layer material. In detail, a heat roller 11 having an outside diameter of 40 mm has an elastic member layer 18 with a 1.5 mm thickness comprising silicone rubber and a PFA (tetrafluoroethylene-perfluoroalkyl vinyl ether copolymer) surface layer 19 on an aluminum center core 17 and is provided with a heater 20 inside the aluminum center core. A press roller 12 having an outside diameter of 35 mm has an elastic member layer 22 with a 3 mm thickness comprising silicone rubber and a PFA surface layer 23 on an aluminum center core 21. At a contact section between the heat roller 11 and the press roller 12, a nip (a nip width of 7 mm) 24 having a convex shape in the side of the heat roller is formed.

The fixing apparatus 2 is a fixing apparatus provided in a digital copying machine Di350 (manufactured by Minolta), belonging to a Teflon hard roller type having a separating pick.

Both apparatuses of them had a constitution in which a web roller for cleaning a fixing roller was arranged, but an experiment was carried out without using a fixing oil. As for the used paper and the passing direction of a sheet of paper, the following conditions disadvantageous to saparabilities were used; a sheet of paper of short grain having a basis weight of 64 g/m$^2$ was passed in the lengthwise direction of the paper. The evaluation was carried out in a fixing temperature range of 120 to 220° C. A peripheral velocity of the fixing apparatus; 120 mm/sec.

○: The separable/non-offset temperature range had a temperature width of not less than 50° C.

Δ: The separable/non-offset temperature range had a temperature width of not less than 30° C. and less than 50° C.

x: The separable/non-offset temperature range had a temperature width of less than 30° C.

(Separating Pick Mark)

In the above-mentioned evaluating method of the separabilities and the anti-offset properties, an image loss caused by a separating pick in the case when a fixation was carried out at 190° C. by means of the fixing apparatus 1 was observed.

○: No image loss was caused by a separating pick.

x: The image loss was caused by a separating pick, and a practical problem was brought about.

(10 k Machine Running)

With respect to a developer, each evaluated toner was blended with the carrier (the ferrite carrier 35 μm obtained by being coated with silicone-acrylic resin) in such a way that the toner mixing ratio was 8% by weight and the blended product was mixed for 30 minutes in order to prepare a starter. Each starter was loaded into the color copying machine CF-900 (manufactured by Minolta), and a durability test (running) was carried out by printing an image on 10000 sheets in order to confirm a practical problem regarding a filming on the image.

○: A practical problem was not brought about.

x: A practical problem was brought about.

TABLE 5

| | Example A1 | | Example A2 | | Example A3 | |
|---|---|---|---|---|---|---|
| Resin | H-type resin 1<br>L-type resin 2 | 100.0<br>(H/L = 60/40) | H-type resin 3<br>L-type resin 4 | 100.0<br>(H/L = 60/40) | Resin 5 | 100.0 |
| Colorant | ClpigmentRED184 | 4.0 | ClpigmentRED184 | 4.0 | ClpigmentRED184 | 4.0 |
| WAX 1 | PW400 | 4.5 | PW400 | 4.5 | PW400 | 4.5 |
| WAX 2 | 660P | 1.0 | 660P | 1.0 | 660P | 1.0 |
| Others | | | | | | |

| | Example A4 | | Example A5 | | Example A6 | |
|---|---|---|---|---|---|---|
| Resin | H-type resin 1<br>L-type resin 2 | 100.0<br>(H/L = 60/40) | H-type resin 1<br>L-type resin 2 | 100.0<br>(H/L = 60/40) | H-type resin 1<br>L-type resin 2 | 100.0<br>(H/L = 60/40) |
| Colorant | ClpigmentRED184 | 4.0 | ClpigmentRED184 | 4.0 | ClpigmentRED184 | 4.0 |
| WAX 1 | H803 | 4.5 | PW655 | 4.5 | PW400 | 4.5 |
| WAX 2 | 660P | 1.0 | 660P | 1.0 | PW1000 | 1.0 |
| Others | | | | | | |

| | Example A7 | | Example A8 | | Example A9 | |
|---|---|---|---|---|---|---|
| Resin | H-type resin 1<br>L-type resin 2 | 100.0<br>(H/L = 60/40) | H-type resin 1<br>L-type resin 2 | 100.0<br>(H/L = 60/40) | H-type resin 1<br>L-type resin 2 | 100.0<br>(H/L = 60/40) |
| Colorant | ClpigmentRED184 | 4.0 | ClpigmentRED184 | 4.0 | ClpigmentRED184 | 4.0 |
| WAX 1 | PW400 | 4.5 | PW400 | 4.5 | PW400 | 4.5 |
| WAX 2 | 440P | 1.0 | 660P | 1.0 | 660P | 1.0 |
| Others | | | | | | |

| | Example A10 | | Example A11 | | Example A12 | |
|---|---|---|---|---|---|---|
| Resin | H-type resin 12<br>L-type resin 2 | 100.0<br>(H/L = 60/40) | H-type resin 1<br>L-type resin 2 | 100.0<br>(H/L = 60/40) | H-type resin 1<br>L-type resin 2 | 100.0<br>(H/L = 60/40) |
| Colorant | ClpigmentRED184 | 4.0 | ClpigmentRED184 | 4.0 | ClpigmentRED184 | 4.0 |
| WAX 1 | | | PW400 | 8.5 | PW400 | 6.5 |
| WAX 2 | 660P | 1.0 | 660P | 1.0 | 660P | 1.0 |
| Others | | | Polymer B1 | 5.0 | Polymer B2 | 5.0 |

TABLE 5-continued

| | Example A13 | | Example A14 | | Comparative Example A1 | |
|---|---|---|---|---|---|---|
| Resin | H-type resin 1<br>L-type resin 2 | 100.0<br>(H/L = 60/40) | H-type resin 1<br>L-type resin 2 | 100.0<br>(H/L = 60/40) | H-type resin 1<br>L-type resin 2 | 100.0<br>(H/L = 60/40) |
| Colorant | ClpigmentRED184 | 4.0 | ClpigmentRED184 | 4.0 | ClpigmentRED184 | 4.0 |
| WAX 1 | PW400 | 7.5 | PW400 | 4.5 | PW400 | 4.5 |
| WAX 2 | 660P | 1.0 | 100TS | 1.0 | | |
| Others | WAX dispersing Agent A | 7.0 | | | | |

| | Comparative Example A2 | | Comparative Example A3 | |
|---|---|---|---|---|
| Resin | H-type resin 1<br>L-type resin 2 | 100.0<br>(H/L = 60/40) | H-type resin 1<br>L-type resin 2 | 100.0<br>(H/L = 60/40) |
| Colorant | ClpigmentRED184 | 4.0 | ClpigmentRED184 | 4.0 |
| WAX 1 | | | PW400 | 4.5 |
| WAX 2 | 660P | 5.5 | 660P | 1.0 |
| Others | | | | |

TABLE 6

| | Example | | | | | | | | |
|---|---|---|---|---|---|---|---|---|---|
| | A1 | A2 | A3 | A4 | A5 | A6 | A7 | A8 | A9 |
| Kneading Temperature | 180° C. | 190° C. | 200° C. | 170° C. | 180° C. | 180° C. | 180° C. | 160° C. | 210° C. |
| Toner Tm | 114.3° C. | 100.3° C. | 90.2° C. | 108.3° C. | 110.2° C. | 114.3° C. | 114.3° C. | 120.1° C. | 108.3° C. |
| WAX1 DSC peak temperature | 76.6° C. | 75.8° C. | 77.1° C. | 65.1° C. | 100.5° C. | 76.9° C. | 77.2° C. | 77.1° C. | 76.3° C. |
| WAX2 DSC peak temperature | 132.7° C. | 133.4° C. | 132.8° C. | 132.5° C. | 132.3° C. | 115.4° C. | 147.5° C. | 134.3° C. | 133.5° C. |
| Softening point of binder resin | 120.2° C. | 112.3° C. | 95.0° C. | 120.2° C. | 120.2° C. | 120.2° C. | 120.2° C. | 120.2° C. | 120.2° C. |
| WAX domain diameter | 1.5 μm | 2.0 μm | 2.6 μm | 10 μm | 1.4 μm | 1.6 μm | 1.6 μm | 0.5 μm | 3.0 μm |
| Fixing apparatus 1 separable/non-offset temperature range | ○ | ○ | ○ | ○ | ○ | ○ | ○ | ○ | ○ |
| Fixing apparatus 2 separable/non-offset temperature range | ○ | ○ | ○ | ○ | ○ | ○ | ○ | ○ | ○ |
| Separating pick mark | ○ | ○ | ○ | ○ | ○ | ○ | ○ | ○ | ○ |
| Maintenance of heat resistance | ○ | ○ | ○ | ○ | ○ | ○ | ○ | ○ | Δ |
| 10 k machine running | ○ | ○ | ○ | ○ | ○ | ○ | ○ | ○ | ○ |

| | Example | | | | | Comparative Example | | |
|---|---|---|---|---|---|---|---|---|
| | A10 | A11 | A12 | A13 | A14 | A1 | A2 | A3 |
| Kneading Temperature | 180° C. | 210° C. | 210° C. | 200° C. | 190° C. | 180° C. | 180° C. | 140° C. |
| Toner Tm | 113.3° C. | 105.6° C. | 105.3° C. | 107.9° C. | 109.1° C. | 113.5° C. | 114.1° C. | 120.1° C. |
| WAX1 DSC peak temperature | 76.9° C. | 77.9° C. | 77.7° C. | 76.9° C. | 76.9° C. | 76.5° C. | — | 77.0° C. |
| WAX2 DSC peak temperature | 133.1° C. | 133.4° C. | 133.7° C. | 132.4° C. | 132.4° C. | — | 132.8° C. | 133.4° C. |
| Softening point of binder resin | 118.1° C. | 120.2° C. | 120.2° C. | 120.2° C. | 120.2° C. | 120.2° C. | 120.2° C. | 120.2° C. |
| WAX domain diameter | 1.5 μm | 3.0 μm | 2.9 μm | 2.5 μm | 2.0 μm | 1.7 μm | 1.3 μm | 0.4 μm |
| Fixing apparatus 1 separable/non-offset temperature range | ○ | ○ | ○ | ○ | ○ | X | X | X |
| Fixing apparatus 2 separable/non-offset temperature range | ○ | ○ | ○ | ○ | ○ | ○ | ○ | ○ |
| Separating pick mark | ○ | ○ | ○ | ○ | ○ | X | ○ | X |
| Maintenance of heat resistance | ○ | Δ | ○ | Δ | ○ | Δ | ○ | ○ |
| 10 k machine running | ○ | ○ | ○ | ○ | ○ | ○ | ○ | ○ |

Experimental Example B

Example B1

When a toner was prepared, the resin obtained by dry-blending the resin 1 and the resin 2 in a weight ratio of 70:30 by means of Henschel mixer was used as a binder resin. The above-mentioned binder resin (100 parts by weight), carbon black (manufactured by Cabot Corporation; Mogul L) (8.0 parts by weight), charge-control agent (manufactured by Orient Kagaku kogyo K.K.; Bontron S-34) (2.5 parts by weight), and WAX1 (4.5 parts by weight) and WAX2 (1.0 parts by weight) shown in Table 7 were mixed by means of Henschel mixer, and then the mixture was kneaded by means of the twin-extruding kneader (PCM-30, manufactured by Ikegai Tekko K.K.) at a kneading temperature of 180° C. The kneaded product was cooled and then coarsely ground by means of the feather mill. Then the coarsely ground product was subjected to a grinding treatment by means of the mechanical grinder A (Criptron grinder, manufactured by Kawasaki Heavy Industries Ltd.) and the ground product obtained was further subjected to a finely grinding treatment by means of the circulating grinder B (Jet mill grinder, manufactured by Nippon Pneumatic K.K.). The finely ground product was classified by means of the mechanical classifier C (ATP classifier, manufactured by Alpine Inc.) and the classification was carried out yet again in the same manner to obtain a toner having a volume-average particle size of about 7 μm. Then hydrophobic silica (manufactured by Hoechst Japan K.K.; H2000) of 0.5% by weight, hydrophobic titania (manufactured by Titan Kogyo K.K.; STT30A) of 0.8% by weight and strontium titanate of 1.25% by weight were added to the toner particles and the mixture was subjected to a mixing treatment by means of Henschel mixer in order to obtain a black toner.

Examples B2 to B14 and Comparative Examples B1 to B3

The toners were obtained by the same preparation method as that described in example B1 except that various materials were used in such a way that the toner composition shown in Table 7 was achieved and the kneading temperature was adjusted to the value shown in Table 8.

As for various items described below, the obtained toners were evaluated, and the evaluation results were shown in Table 8.

A measuring method of wax domain diameter and an evaluating method of heat resistance respectively were same as those described in experimental example A.

(Separabilities/Anti-Offset Properties)

A zonal solid image (toner-coating mass of 5 g/m$^2$) having a width of 36 mm was printed at the 5 mm region from the upper edge in the lengthwise direction on a sheet of A4 size paper in order to form a non-fixed image. Fixing apparatus 2 was alone used. Evaluation was carried out in the same method as the evaluating method of separabilities/anti-offset properties described in experimental example A except that the above-mentioned conditions were used.

(Lowest Fixing Temperature)

In the above-mentioned evaluating method of separabilities/anti-offset properties described in experimental example B, each image was folded in two at the center line in order to visually evaluate its peeling properties at the level in which a practical problem was not brought about. The lowest fixing temperature is the lowest fixing temperature at which the peeling properties can be maintained without bringing out a practical problem.

○: The lowest fixing temperature was in the range of not more than 120° C.

Δ: The lowest fixing temperature was in the range of more than 120° C. and less than 140° C.

x: The lowest fixing temperature was in the range of not less than 140° C.

(50 k Machine Running)

With respect to a developer, each evaluated toner was blended with the carrier (the ferrite carrier 35 μm obtained by being coated with silicone-acrylic resin) in such a way that the toner mixing ratio was 8% by weight and the blended product was mixed for 30 minutes in order to prepare a starter. Each starter was loaded into the copying machine Di350 (manufactured by Minolta), and a durability test (running) was carried out by printing an image on 50000 sheets in order to confirm a practical problem regarding a filming on the image.

○: A practical problem was not brought about.

x: A practical problem was brought about.

TABLE 7

| | Example B1 | | Example B2 | | Example B3 | | Example B4 | |
|---|---|---|---|---|---|---|---|---|
| Resin | H-type resin 1<br>L-type resin 2 | 100.0<br>(H/L = 70/30) | H-type resin 1<br>L-type resin 2 | 100.0<br>(H/L = 70/30) | H-type resin 1<br>L-type resin 2 | 100.0<br>(H/L = 70/30) | H-type resin 1<br>L-type resin 2 | 100.0<br>(H/L = 70/30) |
| Colorant | Mogul L | 8.0 | Mogul L | 8.0 | Mogul L | 8.0 | Mogul L | 8.0 |
| CCA | S-34 | 2.5 | S-34 | 2.5 | S-34 | 2.5 | S-34 | 2.5 |
| WAX 1 | PW400 | 4.5 | H803 | 4.5 | HNP-9 | 4.5 | PW400 | 4.5 |
| WAX 2 | PW1000 | 1.0 | PW1000 | 1.0 | PW1000 | 1.0 | Unilin 700 | 1.0 |
| Others | | | | | | | | |

| | Example B5 | | Example B6 | | Example B7 | | Example B8 | |
|---|---|---|---|---|---|---|---|---|
| Resin | H-type resin 1<br>L-type resin 2 | 100.0<br>(H/L = 70/30) | H-type resin 6<br>L-type resin 7 | 100.0<br>(H/L = 70/30) | H-type resin 8<br>L-type resin 9 | 100.0<br>(H/L = 70/30) | H-type resin 1<br>L-type resin 2 | 100.0<br>(H/L = 70/30) |
| Colorant | Mogul L | 8.0 | Mogul L | 8.0 | Mogul L | 8.0 | Mogul L | 8.0 |
| CCA | S-34 | 2.5 | S-34 | 2.5 | S-34 | 2.5 | S-34 | 2.5 |
| WAX 1 | PW400 | 4.5 | PW400 | 4.5 | PW400 | 4.5 | PW400 | 4.5 |
| WAX 2 | PW655 | 1.0 | PW655 | 1.0 | PW1000 | 1.0 | PW1000 | 1.0 |
| Others | | | | | | | | |

| | Example B9 | | Example B10 | | Example B11 | | Example B12 | |
|---|---|---|---|---|---|---|---|---|
| Resin | H-type resin 1<br>L-type resin 2 | 100.0<br>(H/L = 70/30) | H-type resin 1<br>L-type resin 2 | 100.0<br>(H/L = 70/30) | H-type resin 1<br>L-type resin 2 | 100.0<br>(H/L = 70/30) | H-type resin 1<br>L-type resin 2 | 100.0<br>(H/L = 70/30) |
| Colorant | Mogul L | 8.0 | Mogul L | 8.0 | Mogul L | 8.0 | Mogul L | 8.0 |
| CCA | S-34 | 2.5 | S-34 | 2.5 | S-34 | 2.5 | S-34 | 2.5 |
| WAX 1 | PW400 | 4.5 | | | PW400 | 8.5 | PW400 | 6.5 |
| WAX 2 | PW1000 | 1.0 | PW1000 | 1.0 | PW655 | 1.5 | PW655 | 1.0 |
| Others | | | | | Polymer B1 | 5.0 | Polymer B2 | 5.0 |

TABLE 7-continued

| | Example B13 | | Example B14 | | Comparative Example B1 | | Comparative Example B2 | |
|---|---|---|---|---|---|---|---|---|
| Resin | H-type resin 1<br>L-type resin 2 | 100.0<br>(H/L = 70/30) | H-type resin 1<br>L-type resin 2 | 100.0<br>(H/L = 70/30) | H-type resin 1<br>L-type resin 2 | 100.0<br>(H/L = 70/30) | H-type resin 1<br>L-type resin 2 | 100.0<br>(H/L = 70/30) |
| Colorant | Mogul L | 8.0 | Mogul L | 8.0 | Mogul L | 8.0 | Mogul L | 8.0 |
| CCA | S-34 | 2.5 | S-34 | 2.5 | S-34 | 2.5 | S-34 | 2.5 |
| WAX 1 | PW400 | 7.5 | PW400 | 4.5 | PW400 | 5.5 | | |
| WAX 2 | PW655 | 2.0 | LA05 | 1.0 | | | 660P | 5.5 |
| Others | WAX dispersing agent A | 7.0 | | | | | | |

| | Comparative Example B3 | |
|---|---|---|
| Resin | H-type resin 1<br>L-type resin 2 | 100.0<br>(H/L = 70/30) |
| Colorant | Mogul L | 8.0 |
| CCA | S-34 | 2.5 |
| WAX 1 | PW400 | 4.5 |
| WAX 2 | PW1000 | 1.0 |
| Others | | |

TABLE 8

| | Example | | | | | | | | |
|---|---|---|---|---|---|---|---|---|---|
| | B1 | B2 | B3 | B4 | B5 | B6 | B7 | B8 | B9 |
| Kneading Temperature | 180° C. | 190° C. | 200° C. | 170° C. | 180° C. | 180° C. | 180° C. | 160° C. | 210° C. |
| Toner Tm | 118.8° C. | 116.9° C. | 115.4° C. | 119.3° C. | 117.9° C. | 110.1° C. | 119.8° C. | 121.3° C. | 113.8° C. |
| WAX1 DSC peak temperature | 76.5° C. | 68.6° C. | 73.1° C. | 77.1° C. | 76.2° C. | 76.9° C. | 77.2° C. | 77.1° C. | 76.3° C. |
| WAX2 DSC peak temperature | 113.2° C. | 113.9° C. | 113.3° C. | 103.5° C. | 98.9° C. | 99.0° C. | 113.3° C. | 112.9° C. | 113.2° C. |
| Softening point of binder resin | 124.3° C. | 124.3° C. | 124.3° C. | 124.3° C. | 124.3° C. | 116.6° C. | 125.9° C. | 124.3° C. | 124.3° C. |
| WAX domain diameter | 1.4 μm | 1.8 μm | 2.8 μm | 1.0 μm | 1.4 μm | 1.8 μm | 1.3 μm | 0.5 μm | 3.0 μm |
| Lowest fixing temperature | ○ | ○ | ○ | ○ | ○ | ○ | ○ | ○ | ○ |
| Separable/Non-offset temperature range | ○ | ○ | ○ | ○ | ○ | ○ | ○ | ○ | ○ |
| Maintenance of heat resistance | ○ | ○ | ○ | ○ | ○ | ○ | ○ | ○ | Δ |
| 50 k machine running | ○ | ○ | ○ | ○ | ○ | ○ | ○ | ○ | ○ |

| | Example | | | | | Comparative Example | | |
|---|---|---|---|---|---|---|---|---|
| | B10 | B11 | B12 | B13 | B14 | B1 | B2 | B3 |
| Kneading Temperature | 180° C. | 210° C. | 210° C. | 200° C. | 190° C. | 180° C. | 180° C. | 140° C. |
| Toner Tm | 115.3° C. | 109.6° C. | 110.3° C. | 111.9° C. | 114.1° C. | 117.6° C. | 118.1° C. | 123.7° C. |
| WAX1 DSC peak temperature | 76.9° C. | 77.9° C. | 77.7° C. | 76.9° C. | 76.9° C. | 76.5° C. | — | 77.0° C. |
| WAX2 DSC peak temperature | 112.8° C. | 98.3° C. | 99.1° C. | 98.7° C. | 103.4° C. | — | 132.8° C. | 113.5° C. |
| Softening point of binder resin | 118.1° C. | 124.3° C. | 124.3° C. | 124.3° C. | 124.3° C. | 124.3° C. | 124.3° C. | 124.3° C. |
| WAX domain diameter | 1.5 μm | 3.0 μm | 2.9 μm | 2.5 μm | 2.0 μm | 1.7 μm | 1.3 μm | 0.4 μm |
| Lowest fixing temperature | ○ | ○ | ○ | ○ | ○ | ○ | X | X |
| Separble/Non-offset temperature range | ○ | ○ | ○ | ○ | ○ | X | ○ | ○ |
| Maintenance of heat resistance | ○ | Δ | Δ | Δ | ○ | X | ○ | X |
| 50 k machine running | ○ | ○ | ○ | ○ | ○ | ○ | ○ | X |

Experimental Example C

Example C1

When a toner was prepared, the resin obtained by dry-blending the resin 1 and the resin 2 in a weight ratio of 50:50 by means of Henschel mixer was used as a binder resin. The above-mentioned binder resin (100 parts by weight), carbon black (manufactured by Cabot Corporation; Mogul L) (8.0 parts by weight), charge-control agent (manufactured by Orient Kagaku kogyo K.K.; Bontron S-34) (2.5 parts by weight), and WAX1 (4.5 parts by weight) and WAX2 (1.0 parts by weight) shown in Table 9 were mixed by means of Henschel mixer, and then the mixture was kneaded by means of the twin-extruding kneader (PCM-30, manufactured by Ikegai Tekko K.K.) at a kneading temperature of 180° C. The kneaded product was cooled and then coarsely ground by means of the feather mill. Then the coarsely ground product was subjected to a grinding treatment by means of the mechanical grinder A (Criptron grinder, manufactured by Kawasaki Heavy Industries Ltd.) and the ground product obtained was further subjected to a finely grinding treatment by means of the circulating grinder B (Jet mill grinder, manufactured by Nippon Pneumatic K.K.). The finely ground product was classified by means of the mechanical classifier C (ATP classifier, manufactured by Alpine Inc.) and the classification was carried out yet again in the same manner to obtain a toner having a volume-average particle size of about 7 μm. Then hydrophobic silica (manufactured by Hoechst Japan K.K., H2000) of 0.5% by weight, hydrophobic titania (manufactured by Titan Kogyo K.K.; STT30A) of 0.8% by weight and strontium titanate of 1.25% by weight were added to the toner particles and the mixture was subjected to a mixing treatment by means of Henschel mixer in order to obtain a black toner.

Examples C2 to C13 and Comparative Examples C1 to C3

The toners were obtained by the same preparation method as that described in example C1 except that various materials were used in such a way that the toner composition shown in Table 9 was achieved and the kneading temperature was adjusted to the value shown in Table 10.

As for various items described below, the obtained toners were evaluated, and the evaluation results were shown in Table 10.

A measuring method of wax domain diameter and an evaluating method of heat resistance respectively were same as those described in experimental example A. An evaluating method of separabilities/anti-offset properties was same as that described in experimental example B.

(Smear-Preventive Properties)

In the above-mentioned evaluating method of separabilities/anti-offset properties described in experimental example C, the copied image fixed at 150° C. on the copying sheet and another unused sheet were rubbed together. A stained state of the unused sheet was observed, and was ranked according to the following standard.

○: The stain was hardly conspicuous.

Δ: Although a slight stain was observed, a practical problem was not brought about.

x: The stain was observed on the whole surface, and a practical problem was brought about.

(Fixation Peeling Strength)

In the above-mentioned evaluating method of separabilities/anti-offset properties described in experimental example C, the copied image fixed at 150° C. on the coping sheet was folded in two at the center line in order to visually evaluate its peeling properties.

○: A practical problem was not brought about.

Δ: Although a slight peeling occurred, a practical problem was not brought about.

x: A practical problem was brought about.

(50 k Machine Running)

With respect to a developer, each evaluated toner was blended with the carrier (the ferrite carrier 35 μm obtained by being coated with silicone-acrylic resin) in such a way that the toner mixing ratio was 8% by weight and the blended product was mixed for 30 minutes in order to prepare a starter. Each starter was loaded into the copying machine Di350 (manufactured by Minolta), and a durability test (running) was carried out by printing an image on 50000 sheets in order to confirm a practical problem regarding a filming on the image.

○: A practical problem was not brought about.

x: A practical problem was brought about.

TABLE 9

| | Example C1 | | Example C2 | | Example C3 | | Example C4 | |
|---|---|---|---|---|---|---|---|---|
| Resin | H-type resin 1<br>L-type resin 2 | 100.0<br>(H/L = 60/40) | H-type resin 1<br>L-type resin 2 | 100.0<br>(H/L = 60/40) | H-type resin 1<br>L-type resin 2 | 100.0<br>(H/L = 60/40) | H-type resin 1<br>L-type resin 2 | 100.0<br>(H/L = 50/50) |
| Colorant | Mogul L | 8.0 | Mogul L | 4.0 | Mogul L | 4.0 | Mogul L | 4.0 |
| CCA | S-34 | 2.5 | S-34 | | S-34 | | S-34 | |
| WAX 1 | 800P | 4.5 | 4051E | 4.5 | 405MP | 4.5 | PW1000 | 4.5 |
| WAX 2 | 660P | 1.0 | 660P | 1.0 | 660P | 1.0 | 660P | 1.0 |
| Others | | | | | | | | |

| | Example C5 | | Example C6 | | Example C7 | | Example C8 | |
|---|---|---|---|---|---|---|---|---|
| Resin | H-type resin 1<br>L-type resin 2 | 100.0<br>(H/L = 60/40) | H-type resin 6<br>L-type resin 7 | 100.0<br>(H/L = 50/50) | H-type resin 10<br>L-type resin 11 | 100.0<br>(H/L = 40/60) | H-type resin 1<br>L-type resin 2 | 100.0<br>(H/L = 60/40) |
| Colorant | Mogul L | 4.0 | Mogul L | 4.0 | Mogul L | 4.0 | Mogul L | 8.0 |
| CCA | S-34 | | S-34 | | S-34 | | S-34 | 2.5 |
| WAX 1 | 800P | 4.5 | PW1000 | 4.5 | PW1000 | 4.5 | 800P | 4.5 |
| WAX 2 | 330P | 1.0 | 660P | 1.0 | 660P | 1.0 | 660P | 1.0 |
| Others | | | | | | | | |

| | Example C9 | | Example C10 | | Example C11 | | Example C12 | |
|---|---|---|---|---|---|---|---|---|
| Resin | H-type resin 13<br>L-type resin 2 | 100.0<br>(H/L = 70/30) | H-type resin 1<br>L-type resin 2 | 100.0<br>(H/L = 60/40) | H-type resin 1<br>L-type resin 2 | 100.0<br>(H/L = 60/40) | H-type resin 1<br>L-type resin 2 | 100.0<br>(H/L = 60/40) |
| Colorant | Clpigment-RED184 | 4.0 | Mogul L | 4.0 | Mogul L | 4.0 | Mogul L | 4.0 |
| CCA | | | S-34 | | S-34 | | S-34 | |
| WAX 1 | | | 800P | 7.0 | 800P | 5.5 | PW400 | 7.5 |
| WAX 2 | 660P | 1.0 | 660P | 2.0 | 660P | 2.0 | PW655 | 2.0 |
| Others | | | Polymer B1 | 5.0 | Polymer B2 | 5.0 | Wax dispers-agent A | 7.0 |

TABLE 9-continued

| | Example C13 | | Comparative Example C1 | | Comparative Example C2 | | Comparative Example C3 | |
|---|---|---|---|---|---|---|---|---|
| Resin | H-type resin 1<br>L-type resin 2 | 100.0<br>(H/L = 60/40) | H-type resin 1<br>L-type resin 2 | 100.0<br>(H/L = 60/40) | H-type resin 1<br>L-type resin 2 | 100.0<br>(H/L = 60/40) | H-type resin 1<br>L-type resin 2 | 100.0<br>(H/L = 60/40) |
| Colorant | Mogul L | 4.0 | Mogul L | 4.0 | Mogul L | 4.0 | Mogul L | 4.0 |
| CCA | S-34 | | S-34 | | S-34 | | S-34 | |
| WAX 1 | 800P | 6.5 | 800P | 5.5 | | | 800P | 4.5 |
| WAX 2 | 100TS | 1.0 | | | 660P | 5.5 | 660P | 1.0 |
| Others | | | | | | | | |

TABLE 10

| | Example | | | | | | | |
|---|---|---|---|---|---|---|---|---|
| | C1 | C2 | C3 | C4 | C5 | C6 | C7 | C8 |
| Kneading Temperature | 180° C. | 190° C. | 200° C. | 170° C. | 180° C. | 180° C. | 180° C. | 210° C. |
| Toner Tm | 118.8° C. | 117.3° C. | 116.4° C. | 111.3° C. | 117.9° C. | 102.5° C. | 101.8° C. | 115.5° C. |
| WAX1 DSC peak temperature | 137.5° C. | 119.2° C. | 120.1° C. | 112.5° C. | 138.2° C. | 110.6° C. | 112.5° C. | 138.8° C. |
| WAX2 DSC peak temperature | 144.5° C. | 143.8° C. | 144.6° C. | 144.5° C. | 150.1° C. | 143.5° C. | 144.0° C. | 144.1° C. |
| Softening point of binder resin | 120.2° C. | 120.2 | 120.1° C. | 116.1° C. | 120.2° C. | 107.1° C. | 110.5° C. | 120.2° C. |
| WAX domain diameter | 1.5 μm | 2.2 μm | 2.9 μm | 1.3 μm | 1.5 μm | 1.7 μm | 1.5 μm | 3.0 μm |
| Smear-preventive properties | ○ | ○ | ○ | ○ | ○ | ○ | ○ | ○ |
| Separable/Non-offset temperature range | ○ | ○ | ○ | ○ | ○ | ○ | ○ | ○ |
| Fixation peeling strength | ○ | ○ | ○ | ○ | ○ | ○ | ○ | ○ |
| Maintenance of heat resistance | ○ | ○ | ○ | ○ | ○ | ○ | ○ | Δ |
| 50 k machine running | ○ | ○ | ○ | ○ | ○ | ○ | ○ | ○ |

| | Example | | | | | Comparative Example | | |
|---|---|---|---|---|---|---|---|---|
| | C9 | C10 | C11 | C12 | C13 | C1 | C2 | C3 |
| Kneading Temperature | 180° C. | 210° C. | 210° C. | 200° C. | 180° C. | 180° C. | 180° C. | 140° C. |
| Toner Tm | 117.3° C. | 116.0° C. | 116.5° C. | 117.0° C. | 118.1° C. | 118.2° C. | 118.5° C. | 120.1° C. |
| WAX1 DSC peak temperature | 137.7° C. | 138.1° C. | 138.3° C. | 137.5° C. | 138.0° C. | 139.1° C. | — | 138.1° C. |
| WAX2 DSC peak temperature | 143.3° C. | 144.2° C. | 145.0° C. | 145.1° C. | 144.6° C. | — | 144.0° C. | 143.6° C. |
| Softening point of binder resin | 122.0° C. | 120.2° C. | 120.2° C. | 120.2° C. | 120.0° C. | 120.0° C. | 120.2° C. | 120.° C. |
| WAX domain diameter | 1.6 μm | 3.0 μm | 2.9 μm | 2.5 μm | 2.0 μm | 1.7 μm | 1.5 μm | 0.4 μm |
| Smear-preventive properties | ○ | ○ | ○ | ○ | ○ | ○ | X | X |
| Separable/Non-offset temperature range | ○ | ○ | ○ | ○ | ○ | X | ○ | ○ |
| Fixation peeling strength | ○ | ○ | ○ | ○ | ○ | ○ | Δ | ○ |
| Maintenance of heat resistance | ○ | Δ | Δ | Δ | ○ | X | ○ | ○ |
| 50 k machine running | ○ | ○ | ○ | ○ | ○ | ○ | ○ | ○ |

The other measuring methods used in the present invention will be shown as follows.

(A Measuring Method of a Glass Transition Point (Tg))

A value of the glass transition point was measured by means of a differential scanning calorimeter (DSC-200; manufactured by Seiko Instruments Inc.) under the following condition. A sample of 10 mg was precisely weighed out and the sample was put into an aluminum pan. Alumina being put into an aluminum pan was used as a reference. The sample was heated from room temperature to 200° C. with a heating rate of 30° C./min and then was cooled. The measurement was carried out within the range of 20 to 120° C. with a heating rate of 10° C./min. The shoulder value of a main endothermic peak within the range of 30 to 90° C. in this heating process was defined as the glass transition point.

(A Measuring Method of a Wax Peak Temperature)

A value of the wax peak temperature was measured by means of a differential scanning calorimeter (DSC-200; manufactured by Seiko Instruments Inc.) under the following condition. A sample of 10 mg was precisely weighed out and the sample was put into an aluminum pan. Alumina being put into an aluminum pan was used as a reference. The sample was heated from room temperature to 200° C. with a heating rate of 30° C./min and then was cooled. The measurement was carried out within the range of 20 to 185° C. with a heating rate of 10° C./min. The peak temperature of an endothermic curve caused by the wax in this heating process was defined as the WAX DSC peak temperature.

(A Measuring Method of a Softening Point of a Resin/Toner)

The softening point was measured by means of Flow Tester (CFT-500; manufactured by Shimazu Corporation) under the following condition. A sample of 1.5 mg was precisely weighed out and a die with a size of h1.0 mm×Φ1.0 mm was used. The measurement was carried out under the condition of a heating rate of 3.0° C./min, a preheating time of 180 seconds, a load of 30 kg and a measuring temperature range of 80 to 140° C. The temperature at which half the above-mentioned sample flowed was defined as the softening point.

(A Measuring Method of Mn and Mw)

The molecular weights of Mn and Mw were measured by means of gel permeation chromatography (807-IT type; manufactured by Nippon Bunko Kogyo K.K.) under the following condition. Tetrahydrofuran was run at 1 kg/cm$^2$ as a carrier solvent with the temperature of a chromatographic column maintained at 40° C. A sample (30 mg) was dissolved in tetrahydrofuran (20 ml) and the obtained solution (0.5 mg) was introduced into the apparatus together with the above-mentioned carrier solvent in order to determine Mn and Mw according to a polystyrene conversion method.

(A Measuring Method of Acid Value)

A sample (10 mg) was dissolved in toluene (50 ml), and this solution was titrated by a standardized solution of N/10 potassium hydroxide/alcohol in the presence of a mixed indicator of 0.1% of bromothymol blue and phenol red. The acid value was calculated from the amount of consumption of the solution of N/10 potassium hydroxide/alcohol.

(A Measuring Method of Hydroxyl Value)

A weighed sample was treated with acetic anhydride, and the acetyl compound obtained was subjected to a hydrolysis. The hydroxyl value is the number of mg of potassium hydroxide required for neutralizing the isolated acetic acid.

(A Measuring Method of Content of Insoluble Components in Tetrahydrofuran (THF))

The content of insoluble components in THF was measured by a Soxhlet extracting method in which tetrahydrofuran was used as a solvent and ten hours were passed.

The present invention can provide a toner comprising a comparatively large amount of wax effectively. In the toner, improvements of toner properties by means of adding wax are remarkable. When the first wax and the second wax satisfied with the relation of the specific formula for $T_1$, $T_2$ and Tm are used, anti-offset properties, separabilities, low-temperature fixabilities and smear-preventive properties can be remarkably improved, and excellent heat resistance and anti-filming properties can be maintained.

What is claimed is:

1. A toner for developing an electrostatic latent image comprising a binder resin, a colorant, at least a first wax, and a second wax whose kind is different from that of the first wax, wherein the toner is prepared by a kneading-grinding method and integrated domains comprising at least the first wax and the second wax are dispersed in the binder resin, wherein each of said integrated domains is constituted of plural regions, and wherein at least one of the first wax or the second wax is an acid-modified wax.

2. The toner of claim 1, in which the average particle size of the domains is within the range of 0.5 to 3.0 $\mu$m.

3. The toner of claim 1, in which the total amount of the first wax and the second wax is within the range of 3 to 15 parts by weight with respect to 100 parts by weight of the binder resin.

4. The toner of claim 1, in which at least one of the first wax and the second wax is added at the time of synthesizing the binder resin.

5. The toner of claim 1, in which the toner further comprises a graft polymer prepared by grafting a polyolefin with a vinyl monomer.

6. The toner of claim 1, in which the binder resin comprises a first polyester resin having a softening point of 80 to 120° C. and a second polyester resin having a softening point of 120 to 160° C.

7. The toner of claim 1, in which the binder resin comprises components insoluble in THF in an amount of 0.5 to 30% by weight.

8. The toner of claim 1, in which the softening point (Tm) of the toner, the DSC peak temperature ($T_1$) of the first wax and the DSC peak temperature ($T_2$) of the second wax satisfy the formula $T<Tm<T_2$.

9. The toner of claim 1, in which the softening point (Tm) of the toner, the DSC peak temperature ($T_1$) of the first wax and the DSC peak temperature ($T_2$) of the second wax satisfy the formulae $Tm<T_1$ and $Tm<T_2$.

10. The toner of claim 1, wherein the binder comprises a polyester resin, the first wax comprises a polyethylene and the second wax comprises a polypropylene.

11. A toner for developing an electrostatic latent image comprising a binder resin, a colorant, at least a first wax, and a second wax whose kind is different from that of the first wax, wherein the toner is prepared by a kneading-grinding method and integrated domains comprising at least the first wax and the second wax are dispersed in the binder resin, and wherein the toner further comprises a polymer (B) having a weight-average molecular weight (Mw) of 1000 to 3000 and a ratio of Mw/Mn (wherein Mn is a number-average molecular weight) of 1.0 to 2.0.

12. The toner of claim 11, in which the average particle size of the domains is within the range of 0.5 to 3.0 $\mu$m.

13. The toner of claim 11, in which the total amount of the first wax and the second wax is within the range of 3 to 15 parts by weight per 100 parts by weight of the binder resin.

14. The toner of claim 11, in which the second wax is an acid-modified wax.

15. The toner of claim 11, in which the toner further comprises a graft polymer prepared by grafting a polyolefin with a vinyl monomer.

16. The toner of claim 11, in which the binder resin comprises a first polyester resin having a softening point of 80 to 120° C. and a second polyester resin having a softening point of 120 to 160° C.

17. The toner of claim 16, in which the second wax is added at the time of synthesizing the second polyester resin.

18. The toner of claim 16, in which the polyester resin comprises components insoluble in THF in an amount of 0.5 to 30% by weight.

19. A toner for developing an electrostatic latent image comprising a binder resin, a colorant, at least a first wax, and a second wax whose kind is different from that of the first wax, wherein the toner is prepared by a kneading-grinding method and integrated domains comprising at least the first wax and the second wax are dispersed in the binder resin, and wherein the softening point (Tm) of the toner, the DSC peak temperature ($T_1$) of the first wax and the DSC peak temperature ($T_2$) of the second wax satisfy the formulae $T_1<Tm$ and $T_2<Tm$.

20. The toner of claim 19, in which the average particle size of the domains is within the range of 0.5 to 3.0 $\mu$m.

21. The toner of claim 19, in which the total amount of the first wax and the second wax is within the range of 3 to 15 parts by weight with respect to 100 parts by weight of the binder resin.

22. A toner for developing an electrostatic latent image comprising a binder resin, a colorant, at least a first wax, and a second wax whose kind is different from that of the first wax, wherein the toner is prepared by a kneading-grinding method and integrated domains comprising at least the first wax and the second wax are dispersed in the binder resin, wherein each of said integrated domains is constituted of plural regions, and wherein the softening point (Tm) of the toner, the DSC peak temperature ($T_1$) of the first wax and the DSC peak temperature ($T_2$) of the second wax satisfy the relation of the formula: $T_1<Tm<T_2$.

23. A toner for developing an electrostatic latent image comprising a binder resin, a colorant, at least a first wax, and a second wax whose kind is different from that of the first wax, wherein the toner is prepared by a kneading-grinding method and integrated domains comprising at least the first wax and the second wax are dispersed in the binder resin, wherein each of said integrated domains is constituted of plural regions, and wherein the softening point (Tm) of the toner, the DSC peak temperature ($T_1$) of the first wax and the DSC peak temperature ($T_2$) of the second wax satisfy the relation of the formulae: $Tm<T_1$ and $Tm<T_2$.

* * * * *